US009175685B2

(12) United States Patent
Bissell

(10) Patent No.: US 9,175,685 B2
(45) Date of Patent: Nov. 3, 2015

(54) LIQUID RING PUMP WITH GAS SCAVENGE DEVICE

(75) Inventor: Douglas Eric Bissell, Monroe, CT (US)

(73) Assignee: GARDNER DENVER NASH, LLC, Trumbull, CT (US)

( * ) Notice: Subject to any disclaimer, the term of this patent is extended or adjusted under 35 U.S.C. 154(b) by 866 days.

(21) Appl. No.: 13/139,468

(22) PCT Filed: Dec. 18, 2008

(86) PCT No.: PCT/US2008/087439
§ 371 (c)(1),
(2), (4) Date: Jun. 13, 2011

(87) PCT Pub. No.: WO2010/071651
PCT Pub. Date: Jun. 24, 2010

(65) Prior Publication Data

US 2011/0243758 A1 Oct. 6, 2011

(51) Int. Cl.
*F04C 19/00* (2006.01)

(52) U.S. Cl.
CPC ..... *F04C 19/008* (2013.01); *F04C 19/001* (2013.01); *F04C 19/005* (2013.01); *F04C 2240/20* (2013.01)

(58) Field of Classification Search
CPC ..... F04C 19/00; F04C 19/005; F04C 19/007; F04C 19/008
USPC ..... 417/68
See application file for complete search history.

(56) References Cited

U.S. PATENT DOCUMENTS 2,911,137 A 11/1959 Edwards
2,937,499 A * 5/1960 Klemt ..... 123/234
3,894,812 A * 7/1975 Huse ..... 417/68
4,251,190 A 2/1981 Brown et al.
4,392,783 A 7/1983 Jozepaitis
4,679,987 A * 7/1987 Olsen ..... 417/54

(Continued)

FOREIGN PATENT DOCUMENTS

DE 258483 4/1913
DE 23 17 420 3/1975

(Continued)

OTHER PUBLICATIONS

International Search Report for PCT/US08/87439 dated Feb. 20, 2009 (2 pages).
PCT Written Opinion of the International Searching Authority for International Application No. PCT/US08/87439 dated Feb. 20, 2009 (5 pages).

(Continued)

*Primary Examiner* — Peter J Bertheaud
(74) *Attorney, Agent, or Firm* — Michael Best & Friedrich LLP

(57) ABSTRACT

A liquid ring pump having a channel including a first opening which opens into a first bucket formed by rotor blades. The first opening is located along an arcuate path between a closing edge of an inlet port and a leading edge of a discharge port The inlet port and discharge port are in a port plate of the liquid ring pump. The channel has a second opening which opens into a second bucket formed by rotor blades The second opening is on an arcuate path between a closing edge of the discharge port and a leading edge of the inlet port. A fluid pathway interconnects the first and second openings. At least a portion of the liquid ring pump forming the channel is disposed in a circumferential cylindrical cavity, wherein the cavity is formed from a plurality of axially extending rotor blade ends.

30 Claims, 4 Drawing Sheets

(56) References Cited

U.S. PATENT DOCUMENTS

| | | | | |
|---|---|---|---|---|
| 4,747,752 | A | 5/1988 | Somarakis | |
| 4,850,808 | A | 7/1989 | Schultze et al. | |
| 5,122,035 | A * | 6/1992 | Juhola | 417/68 |
| 5,246,348 | A | 9/1993 | Wallace et al. | |
| 5,507,625 | A | 4/1996 | Dudeck | |
| 5,605,445 | A | 2/1997 | Trimborn | |
| 5,769,609 | A | 6/1998 | Plescher et al. | |

FOREIGN PATENT DOCUMENTS

| | | |
|---|---|---|
| JP | 51-101209 | 9/1976 |
| JP | 55-102402 | 8/1980 |
| JP | S62271991 | 11/1987 |
| JP | 2002527671 | 8/2002 |
| WO | WO 00/22303 | 4/2000 |

OTHER PUBLICATIONS

PCT International Preliminary Report on Patentability issues in connection with Interational Application No. PCT/US2008/087439 dated Jun. 27, 2011(7 pages).

Claims of International Preliminary Report on Patentability for PCT/US08/87439, dated Jun. 27, 2011 (6 pages).

English translation of Japanese Office Action for companion case 2011-542096, dated Apr. 23, 2013 (5 pages).

English Summary of Chinese Office Action for companion case 20088013243.1, dated Mar. 31, 2014 (3 pages).

Australian Patent Examination Report No. 1 regarding Australian companion case application No. 2008365244, dated May 8, 2014 (4 pages).

Extended European Search Report regarding related case EP 08 879032, dated Nov. 14, 2014 (6 pages).

* cited by examiner

LIQUID RING PUMP WITH GAS SCAVENGE DEVICE

FIELD OF INVENTION

The present invention relates to a liquid ring pump. More particularly, the invention relates to a channel which fluidly interconnects buckets of a rotor of a liquid ring pump.

BACKGROUND

Liquid ring pumps are well known. U.S. Pat. No. 4,850,808, Schultze, discloses such a liquid ring pump. The pump is conically ported (conical liquid ring pump) and has one or two stages. The pump includes a housing; a rotor assembly within the housing; a shaft extending into the housing on which the rotor assembly is fixedly mounted; and a motor assembly coupled to the shaft. During operation, the housing is partially filled with operating liquid so that when the rotor is rotating, the rotor blades engage the operating or pumping liquid and cause it to form an eccentric ring that diverges and converges in the radial direction relative to the shaft. Where the liquid is diverging from the shaft, the resulting reduced pressure in the spaces between adjacent rotor blades of the rotor assembly (buckets) constitutes a gas intake zone. Where the liquid is converging towards the shaft, the resulting increased pressure in the spaces between adjacent rotor blades (buckets) constitutes a gas compression zone. A cone shaped member is mated within a cone shaped bore of the rotor assembly. The cone shaped member is ported to allow gas that would otherwise be carried over from the compression zone, to bypass the intake zone and re-enter the compression zone.

U.S. Pat. No. 4,251,190, Brown discloses a water ring rotary air compressor. The compressor includes a housing; a rotor assembly disposed within the housing; a motively powered shaft extending into the housing and fixedly coupled to the rotor assembly. The rotor assembly utilizes a pumping liquid and creates an eccentric ring in a manner similar to U.S. Pat. No. 4,850,808. A port plate or head has a circumferential extension extending into a cylindrical bore of the rotor assembly. A port sleeve is disposed and press fit around the cylindrical extension. The sleeve includes a circumferential groove and a plurality of longitudinally extending slots. The sleeve reduces cavitation.

SUMMARY

It is advantageous to reduce complex machining and shimming associated with conical liquid ring pumps. Accordingly, the present invention provides a channel in a portion of a liquid ring pump. The channel has a first opening which opens into a first bucket formed by rotor blades. The first opening is located along an arcuate path between a closing edge of an inlet port and a leading edge of a discharge port. The inlet port and discharge port are in a port plate of the liquid ring pump.

The channel has a second opening which opens into a second bucket formed by rotor blades. The second opening is on an arcuate path between a closing edge of the discharge port and a leading edge of the inlet port. A fluid pathway interconnects the first and second openings. At least a portion of the liquid ring pump forming the channel is disposed in a circumferential cylindrical cavity, wherein the cavity is formed from a plurality of axially extending rotor blade ends. The portion of the liquid ring pump providing the channel can be a removable cylinder.

The channel is isolated and sealed off from the discharge port and the inlet port of the port plate when the pump is in the running mode. The invention is described. The invention is shown in the figures.

DETAILED DESCRIPTION

Figure 1:
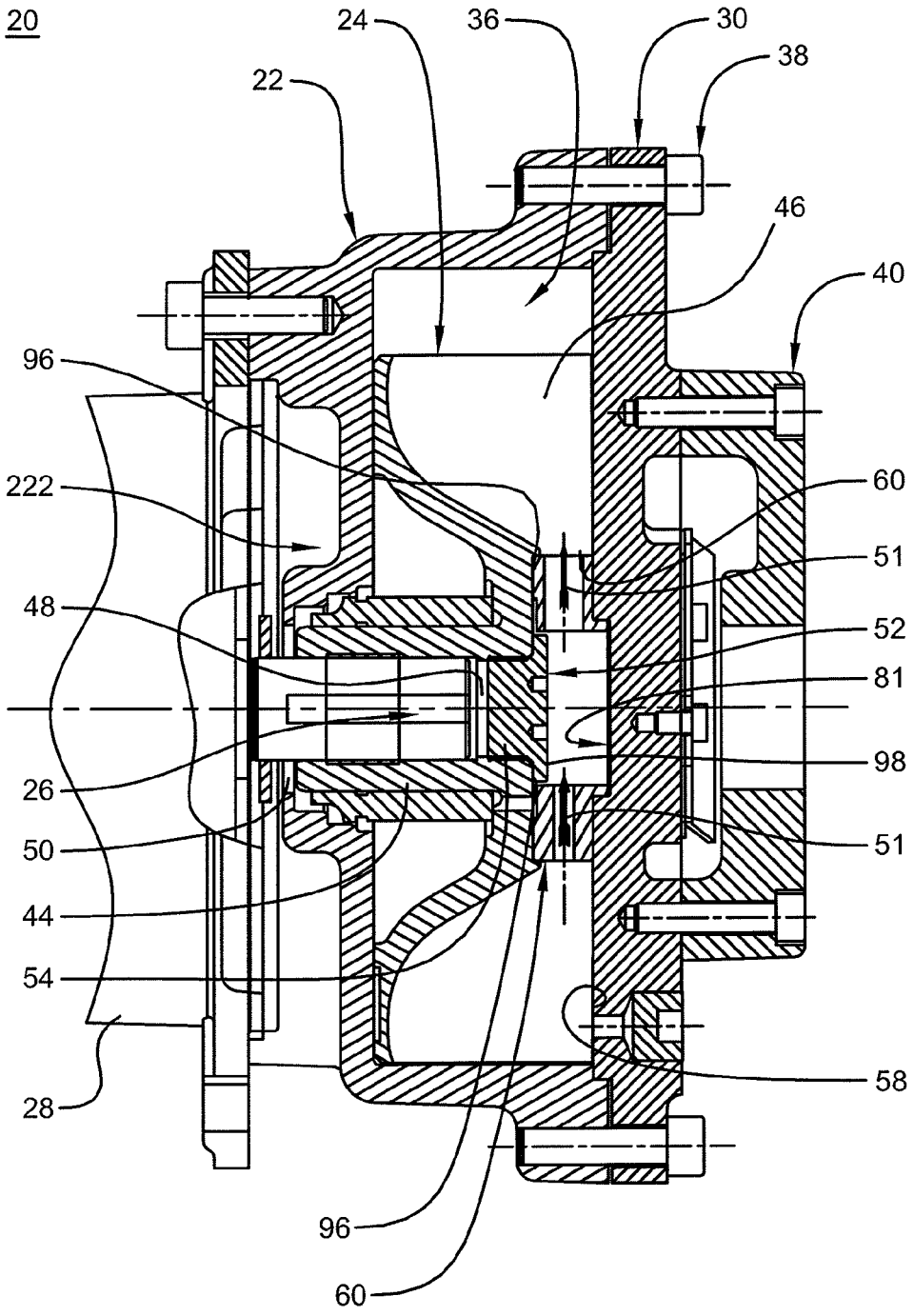
FIG. 1 is an irregular partial sectional view taken parallel to the shaft of a liquid ring pump embodying the invention.
Figure 2A:
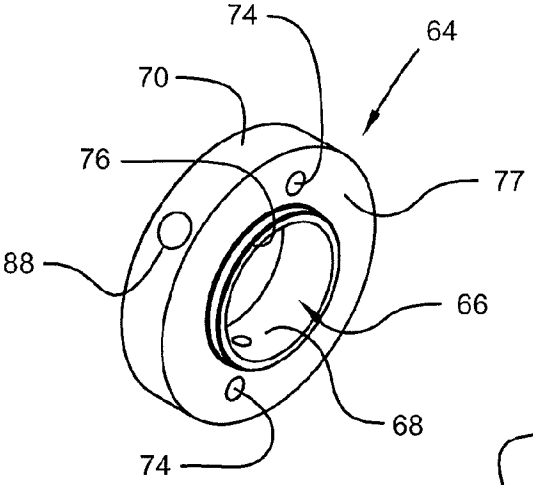
FIG. 2A is a perspective view of the cylinder in which the sealed channel is formed.
Figure 2D:
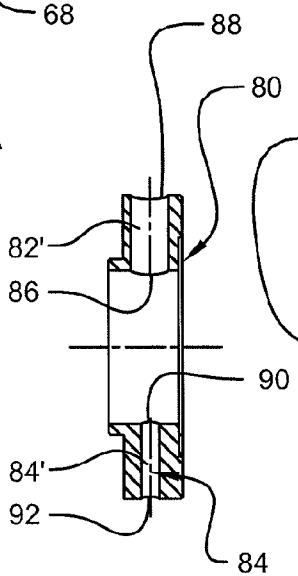
FIG. 2D is a sectional view taken along view lines 2D-2D of FIG. 2C.
Figure 2E:
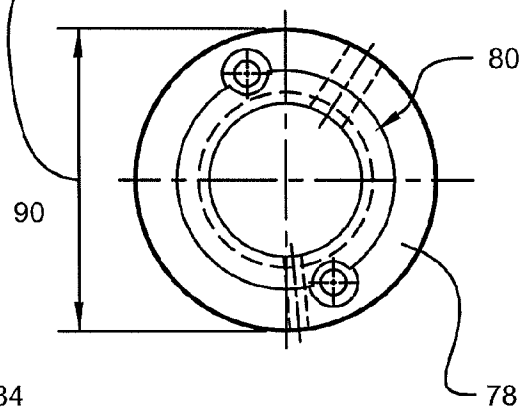
FIG. 2E is a rear side plan view of the cylinder shown in FIG. 2A.
Figure 2C:
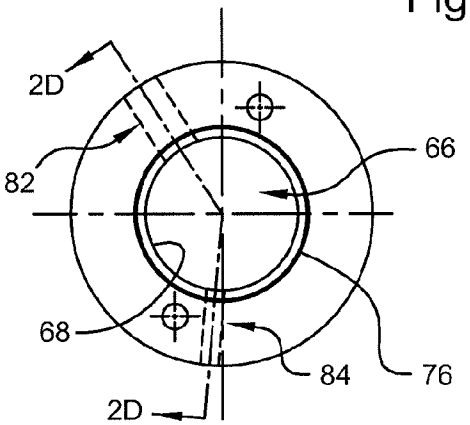
FIG. 2C is a front side plan view of the cylinder shown in FIG. 2A.
Figure 2B:
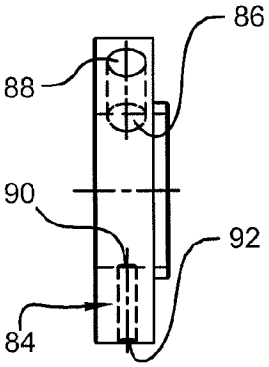
FIG. 2B is a right side plan view of the cylinder shown in FIG. 2A.

As can be seen with reference to FIGS. 1-4, liquid Ring Pump 20 includes an annular housing 22, a rotor 24 within the housing, with a shaft 26 of driver or prime mover 28 extending into the housing. The rotor 24 is fixedly mounted to shaft 26. The housing 22 forms a lobe which provides a cavity 36 in which rotor 24 and operating liquid 53 are disposed. Port plate 30 covers an open end of housing 22. The port plate has a gas inlet port 32 and a gas discharge port 34 from which gas enters and exits spaces 49 formed by successive or adjacent rotor blades 46, said spaces referred to as buckets. Each bucket is sealed off by the inner surface of the operating liquid 53 when the pump is in the running mode. Thus the buckets, when the pump is in the running mode, are sealed buckets. Port plate 30 is secured to housing 22 by way of screws 38 or other appropriate means. A connection plate 40 is secured to port plate 30 by way of screws or other appropriate means. The housing at a closed end 222 is secured to driver 28. In the shown example, driver 28 is a motor. Of course, the driver could be an electric motor or something other than a motor.

Rotor 24 includes a hub 44 from which rotor blades 46 extend. A cylindrical bore 48 extends into the hub. Shaft 26, extending through housing bore 50, extends into cylindrical bore 48. In the embodiment shown in FIG. 1, the shaft has a free end oriented towards port plate 30. The free end is adjacent plug 52. Plug 52 has a body 54 that is secured in hub bore open end 56. The hub 44 is fixedly mounted to shaft 26.

Each rotor blade 46 has a free axial end 58 adjacent port plate 30, which extends in the radial direction relative to shaft 26. Each rotor blade 46 has a horizontally extending free end 60, extending in the axial direction relative to shaft 26. Each horizontal free end 60 is substantially parallel to shaft 26. The horizontal free ends 60 form a circular cavity 62 defining a circumference and do not form a conical cavity. Arrow 55 illustrates the direction of rotation of the rotor 24.

A device 64 is disposed between port plate 30 and rotor 24. FIG. 1 shows device 64 installed in the liquid ring pump 20. Device 64 is a component of the liquid ring pump. As seen in FIG. 2A-2E, device 64 is generally a circular cylinder. Device 64 has a circular bore 66 defined by counter bore 68. Device 64 has a circumferential surface 70 and diameter 72. Device 64 is sized to fit within circular cavity 62. There is a running clearance between circumferential surface 70 and horizontal free ends 60. The amount of clearance depends upon the pump volume and other known factors. Extending from a first end face 77 of device 64 is a circular collar, boss or ring 76 having a diameter smaller than diameter 72. The circular collar 76 is a locating member to position the device 64 relative to plate 30. The locating member could be any number of structures. Device 64 has a second end face 78. The second end face 78 has a flat recessed surface forming a circumferential recess 80. The recess 80 provides a passage for lubrication. Device 64 has a gas discharge channel 82 and a gas inlet channel 84. Gas discharge channel 82 extends in the radial direction through a portion of device 64 such that channel 82 has a first opening 86 which opens into bore 66 through counter bore 68; and a second opening 88 which opens through circumferential surface 70. Channel 82' joins openings 86 and 88. Thus, channel 82 comprises channel 82', 86, and 88. Gas inlet channel 84 extends in the radial direction through a portion of device 64 such that inlet channel 84 has an opening 90 which opens into bore 66 through counter bore 68. Inlet channel 84 also has an opening 92 which opens through circumferential surface 70. Channel 84' joins openings 90 and 92. Thus, channel 84 comprises channel 84', 90, and 92.

When device 64 is installed, the second end face 78 is oriented to face away from port plate 30 and towards the housing closed end 222. Second end face 78 is near rotor hub end face 96. The amount of clearance depends upon the pump volume and other known factors. Plug cover 98 fits within the bore 66.

The first end face surface 77 abuts against port plate 30. Collar 76 fits within circumferential port plate recess 81 to seal off bore 66 at the first end face surface 77. Device 64 is oriented so it fits within rotor cylindrical cavity 62 and so its diameter is substantially perpendicular to shaft 26. First end face surface 77 has one or more fastener receiving through holes 74 which receive fasteners to secure cylinder 64 to port plate 30.

Figure 3:
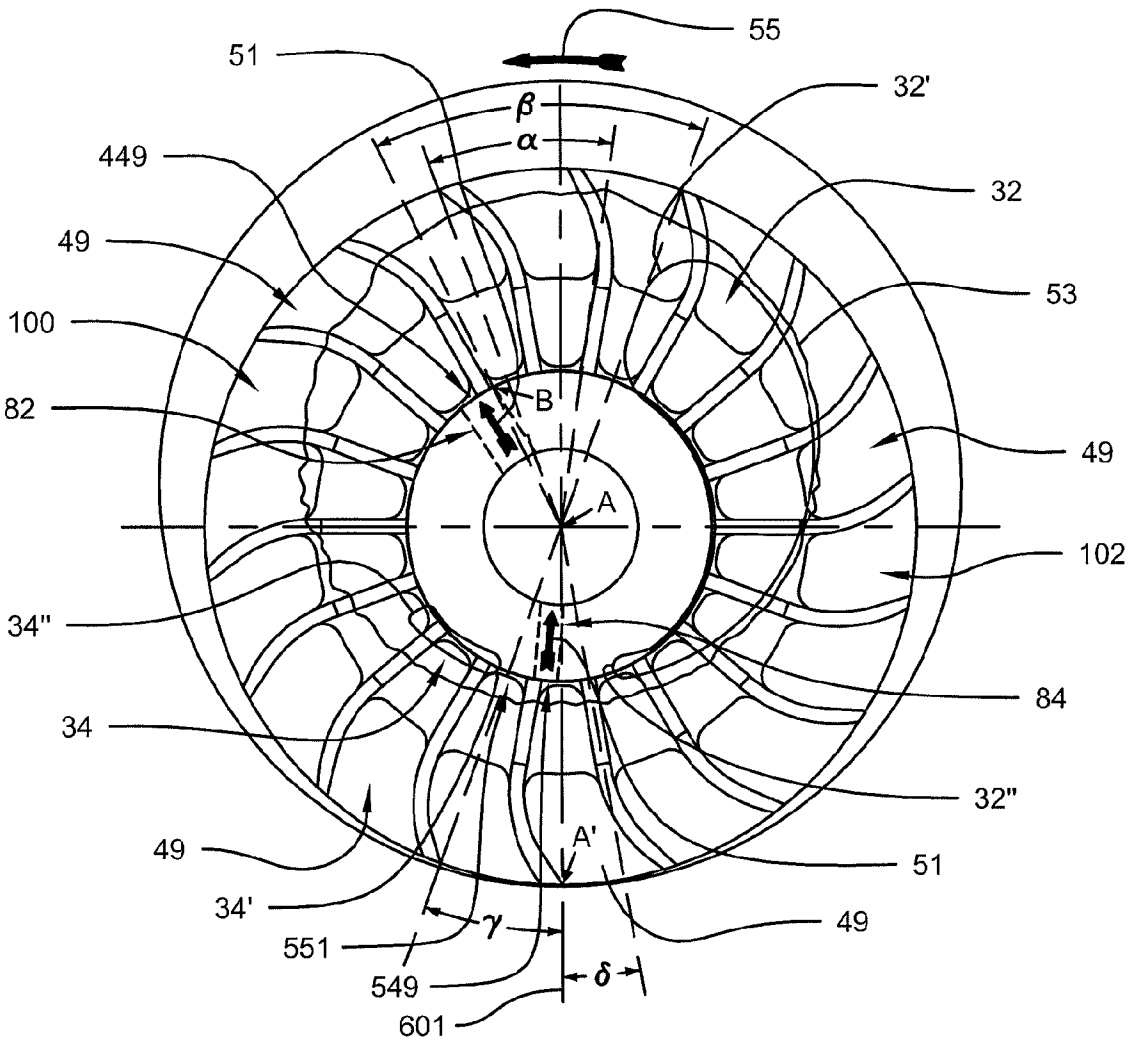
FIG. 3 is a schematic sectional representation taken perpendicular to the shaft of the liquid ring pump to highlight the relative position of the rotors, operating liquid, inter-blade spaces, inlet port, discharge port, and fluid pathway formed in the cylinder when the pump is in the running mode.
Figure 4:
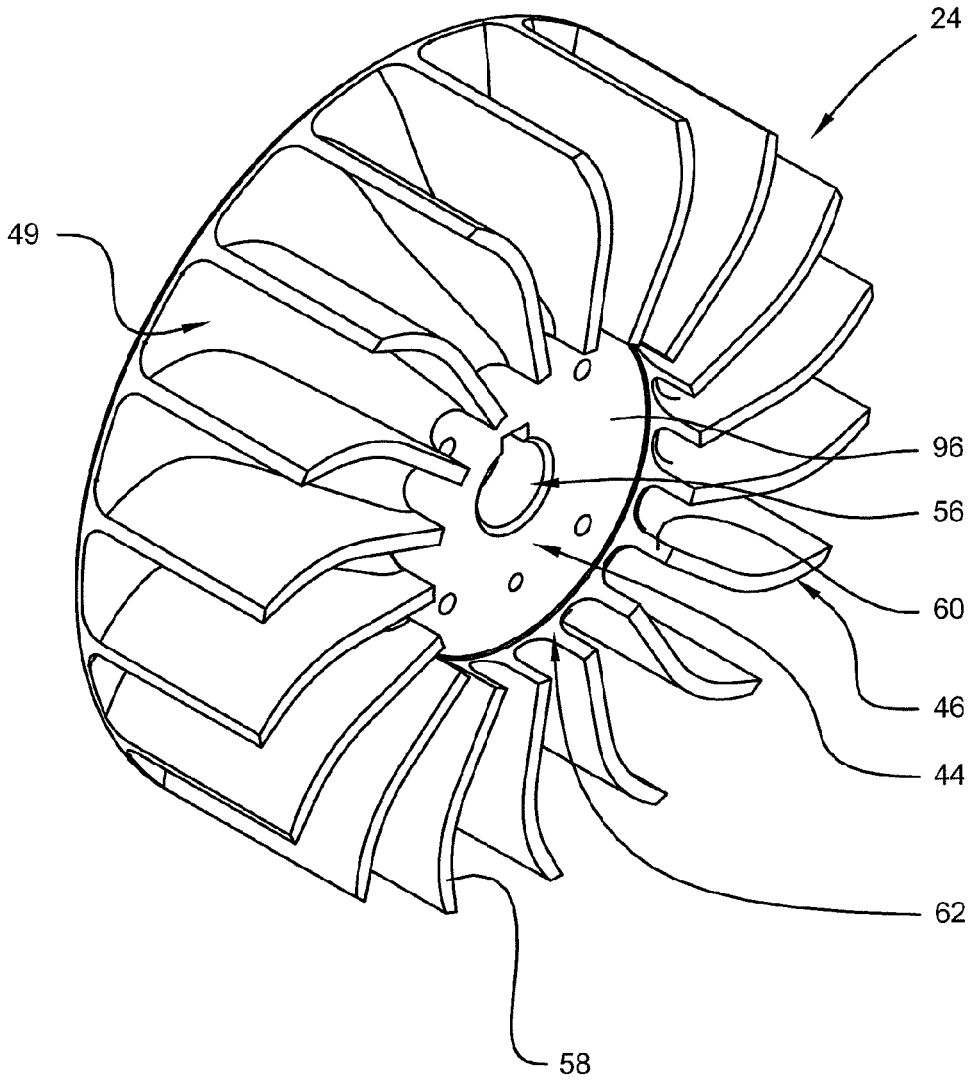
FIG. 4 is a front perspective view of the rotor shown in FIG. 1.

As can be seen in FIG. 3, discharge channel 82 is circumferentially located between inlet port closing edge 32' and discharge port leading edge 34". The position of discharge channel 82 is determined by the geometry of rotor blade 46, the angular spacing between successive blades 46, and the position of inlet port closing edge 32'. It is preferable that the angle $\beta$ between the closing edge 32' and a point tangent to or a point at the beginning (point B) of channel 82 be greater than the included angle $\alpha$ between successive blades 46. Angle $\beta$ can be equal to or greater than angle $\alpha$ Inlet channel 84 is circumferentially located between discharge port closing edge 34' and inlet port leading edge 32". The position of inlet channel 84 is determined by the geometry of the internal surface of housing 22, the geometry of rotor blade 46, the angular spacing $\alpha$ between successive blades 46, the position of discharge port closing edge 34', and the position of inlet port leading edge 32". If a line 601 is constructed from the shaft center (point A) to the point of closest approach of the tip of rotor blade 46 to the internal surface of housing 22 (point A'), then channel 84 is preferably located within 20 angular degrees (angle $\gamma$) before said line and 10 angular degrees (angle $\delta$) after said line, the variation being dependent on the geometry of the rotor 24 and included angle $\alpha$.

In the running mode the channel comprised of bore 66, discharge channel 82 and inlet channel 84 is isolated and sealed off from discharge port 34 and inlet port 32. Therefore, device 64, when the pump is in the running mode, provides an isolated and sealed channel 66, 82, 84. The sealing and isolation occurs because in the running mode, running clearances, such as the clearance between end face 78 and hub end face 96, are sealed by the operating liquid. If the pump is shut down and the operating liquid is absent, then the running clearances would be unsealed. In this case, device 64 could be considered to have a substantially sealed and isolated channel 66, 82, 84, i.e., sealed except for unsealed running clearances. As can be seen in the figures, channel 82', opening 86, bore 66, opening 90, and channel 84' form a fluid pathway interconnecting openings 88 and 92.

The sealed channel 66, 82, 84 allows gas 551, trapped in a sealed bucket 49 which has rotated to position 549, to escape from this bucket and be deposited in a sealed bucket 49 which has rotated to position 449. Thus, gas 551 that would otherwise be carried over from the compression zone 100 to intake zone 102 is allowed to bypass intake zone 102 and re-enter compression zone 100. This improves the pump's efficiency. Generally, the gas 551 flows in the direction of arrows 51.

A bucket 49 is in position 549 when it has swept past port plate discharge port closing edge 34' but not yet begun to sweep by port plate inlet leading edge 32". A bucket 49 is in position 449 when it has swept past port plate inlet closing edge 32' but not yet begun to sweep by port plate discharge port leading edge 34".

Though the invention has been described by reference to an example of a single stage liquid ring pump, the invention is equally applicable to two stage liquid ring pumps or pumps having two or more single staged sections. The above is only an example of an embodiment of the invention. There are other examples which would include different embodiments of the invention. For example, the exit of channel 66, 82', 84' could be in the port plate. The device can be integral or separable from the port plate. Accordingly, many modifications and variations in the present invention are possible in light of the above teachings. It is to be understood that within the scope of the appended claims, the invention may be practiced otherwise then as specifically described herein. The recitations in the claims are to be read inclusively.

What is claimed:

1. A pathway formed in a portion of a liquid ring pump, said liquid ring pump comprising a housing, a port plate, a rotor, and a shaft; said housing forms a housing cavity in which said rotor is disposed, said shaft extends into said cavity and into a bore formed in a hub of said rotor; a plurality of rotor blades of said rotor extend radially outward from said hub, each of said rotor blades have an end extending in the axial direction relative to said shaft, said axially extending ends form a circumferential cylindrical cavity, said circumferential cylindrical cavity being a non-conical cavity, a plurality of buckets are formed by said plurality of rotor blades; said port plate is coupled to an open end of said housing, said port plate has a discharge port and an inlet port each of which open into said housing cavity, said discharge port and said inlet port each have a leading edge and a closing edge, said port plate is non-conical and without a gas bypass, a first bucket of said plurality of said buckets between the closing edge of said inlet port and leading edge of said discharge port, a second bucket of said plurality of said buckets is between said closing edge of said discharge port and said leading edge of said inlet port; said pathway formed in said liquid ring pump comprising:

a first opening which opens into said first bucket, said first opening is between said closing edge of said inlet port and said leading edge of said discharge port;

a second opening which opens into said second bucket, said second opening between said closing edge of said discharge port and a leading edge of said inlet port;

said first and second openings of said pathway being interconnected wherein said pathway allows for the flow of gas through the circumferential cylindrical cavity from said second bucket to said first bucket and further is adapted to be isolated from and sealed off from said discharge port and inlet port in said port plate when said pump is in a running mode;

said first bucket comprised of a mixture of gas from said inlet port and said pathway when said pump is in a running mode.

2. A pathway formed in a portion of a liquid ring pump, said pathway comprising:

a first opening which opens into a first bucket formed by adjacent rotor blades of a rotor of said liquid ring pump, said first opening is between a closing edge of an inlet port of said liquid ring pump and a leading edge of a discharge port of said liquid ring pump;

a second opening which opens into a second bucket formed by adjacent rotor blades of said rotor, said second opening between a closing edge of said discharge port and a leading edge of said inlet port, said inlet port and discharge port in a port plate;

said first and second openings of said pathway being interconnected, wherein said pathway allows for the flow of gas through a circumferential cylindrical cavity, formed by rotor blades of said rotor, from said second bucket to said first bucket and further is adapted to be isolated from and sealed off from said discharge port and inlet port in said port plate when said pump is in a running mode, wherein horizontally extending free ends of said rotor blades which are substantially parallel to a shaft on which said rotor is mounted delimit said circumferential cylindrical cavity through which said gas pathway allows for flow of said gas, said first and second openings overlapped by said horizontally extending free ends when said pump is in a running mode;

said first bucket comprised of a mixture of gas from said inlet port and said pathway when said pump is in said running mode, and said cavity without said discharge port or said inlet port disposed therein when said pump is in said running mode.

3. A component of a liquid ring pump, said component comprising:

a first gas opening formed in said component;

a second gas opening formed in said component;

wherein when said component of said liquid ring pump is installed in said liquid ring pump, said first gas opening opens into a first bucket formed by adjacent rotor blades of a rotor of said liquid ring pump, said first gas opening is between a closing edge of an inlet port of said liquid ring pump and a leading edge of a discharge port of said liquid ring pump, said inlet port and discharge port in a port plate, said component without said inlet port or discharge port disposed therein;

wherein said second gas opening opens into a second bucket formed by adjacent rotor blades of said rotor, said second gas opening between a closing edge of said discharge port and a leading edge of said inlet port;

a pathway interconnecting said first and second gas openings, wherein said pathway allows for the flow of gas through a cylindrical cavity of the component from said second bucket to said first bucket and further is adapted to be isolated from and sealed off from said discharge port and inlet port in said port plate when said pump is in a running mode;

said first bucket comprised of a mixture of gas from said inlet port and said pathway when said pump is in said running mode; and wherein when installed said component of said liquid ring pump is disposed, at least partially, in a circumferential cylindrical cavity delimited by horizontally extending free ends of rotor blades of said rotor, said first and second opening are in said circumferential cavity delimited by said horizontally extending free ends, said free ends delimiting said cavity in which said first and second openings are substantially parallel to a shaft to which said rotor is mounted.

4. A component of a liquid ring pump, said component comprising:

a first and second face, an exterior surface between an edge of the first face and an edge of the second face, and a central bore extending through the component between the first and second face, the central bore defined by an interior surface;

a first gas channel formed in said component, the first gas channel radially extending from the center bore between an opening in the interior surface and an opening in the exterior surface;

a second gas channel formed in said component, the second gas channel radially extending from the center bore between an opening in the interior surface and an opening in the exterior surface;

a pathway interconnecting said first and second channels, wherein when said component is installed in the liquid ring pump, the pathway allows for the flow of gas from an area outside the exterior surface, through the second channel to the central bore and from the central bore through the first channel to an area outside the exterior surface;

wherein when said component is installed in said liquid ring pump, a beginning point of said first gas channel or a point tangent to said first gas channel is an angle from a closing edge of an inlet port in a port plate of said liquid ring pump, said port plate having a discharge port, and angle $\beta$ is greater than or equal to an angle $\alpha$, wherein angle $\alpha$ is an included angle between successive rotor blades of a rotor of said liquid ring pump; and wherein when said component is installed in said liquid ring pump, said second gas channel is within $\gamma$ angular degrees in front of a line, said line extending from a center point of a shaft of said liquid ring pump to a point of closest approach of a tip of a rotor blade to an internal surface of a housing enclosing said rotor blade, to $\delta$ angular degrees after said line, and $\gamma$ is greater than or equal to $\delta$.

5. A gas pathway formed in a portion of a liquid ring pump, said pathway comprising:

an interior gas chamber, the interior chamber enclosed by at least one barrier separating the interior chamber from a cavity housing a gas inlet port, a gas discharge port and a rotor of the liquid ring pump said gas inlet port and gas discharge port in a port plate;

a first gas channel radially extending through the at least one barrier from the interior chamber to the cavity, a beginning point of said first gas channel or a point tangent to said first gas channel is an angle from a closing edge of the inlet port, and is greater than or equal to an angle a, wherein angle a is an included angle between successive rotor blades of the rotor;

a second gas channel radially extending through the at least one barrier from-the interior chamber to the cavity, said second gas channel is within $\gamma$ angular degrees in front of a line, said line extending from a center point of a shaft of said liquid ring pump to a point of closest approach of a tip of a rotor blade to an internal surface of a housing enclosing said rotor blade, to $\delta$ angular degrees after said line, and $\gamma$ is greater than or equal to $\delta$; and the pathway providing for gas introduced into the cavity by the gas intake port to circulate from the cavity through the second gas channel to the interior chamber and be returned from the interior chamber to the cavity through the first gas channel.

6. The pathway of claim 5 wherein a portion of the liquid ring pump forming the pathway is disposed at least partially, in a circumferential cylindrical cavity formed by rotor blades of said rotor.

7. The component of claim 4 wherein the component is disposed, at least partially, in a circumferential cylindrical cavity formed by rotor blades of said rotor.

8. The pathway of claim 1, 2 or 5 wherein the portion of the liquid ring pump forming the pathway is a cylinder.

9. The component of claim 3, 4 or 7 wherein the component is substantially cylindrical in shape.

10. The component of claim 4 or 7 wherein the angle $\gamma$ and $\delta$ are dependent on the geometry of said rotor and the included angle $\alpha$.

11. The pathway of claim 5 or 6 wherein the angle $\gamma$ and $\delta$ are dependent on the geometry of said rotor and the included angle $\alpha$.

12. The component of claim 4 or 7 wherein the angle $\gamma$ is less than or equal to 20 degrees and the angle $\delta$ is less than or equal to 10 degrees.

13. The pathway of claim 5 or 6 wherein the angle $\gamma$ is less than or equal to 20 degrees and the angle $\delta$ is less than or equal to 10 degrees.

14. The pathway of claim 1 or 2 wherein the first opening is an opening from a discharge channel and the second opening is an opening into an inlet channel.

15. The pathway of claim 14 wherein the discharge channel has a cross-sectional area greater than the cross-sectional area of the inlet channel.

16. The pathway of claim 14 wherein the discharge channel has a cross-sectional area twice the cross-sectional area of the inlet channel.

17. The component of claim 4 where the exterior surface is substantially smooth.

18. The component of claim 4 further comprising at least one aperture extending axially though the component between the first and second face, the at least one aperture positioned between the interior and exterior surfaces and suitable for accommodating a fastener.

19. The component of claim 4 where the component is secured to said port plate by at least one fastener extending through an aperture on the first face of the component.

20. The component of claim 4 further comprising an annular collar extending from the first face, the collar having a diameter smaller than a diameter of the exterior surface.

21. The pathway of claim 1 wherein said inlet port is the only gas inlet port in the port plate and said discharge port is the only gas discharge port in the port plate.

22. The pathway of claim 2 wherein said inlet port is the only gas inlet port in the port plate and said discharge port is the only gas discharge port in the port plate.

23. The component of claim 3 wherein said inlet port is the only gas inlet port in the port plate and said discharge port is the only gas discharge port in the port plate.

24. The pathway of claim 5 wherein said gas inlet port is the only gas inlet port in the port plate and said gas discharge port is the only gas discharge port in the port plate.

25. The component of claim 4 wherein said inlet port is the only gas inlet port in the port plate.

26. The pathway of claim 1 wherein said liquid ring pump has at least two single staged sections.

27. The pathway of claim 2 wherein said liquid ring pump has at least two single staged sections.

28. The pathway of claim 5 wherein said liquid ring pump has at least two single staged sections.

29. The component of claim 3 wherein said liquid ring pump has at least two single staged sections.

30. The component of claim 4 wherein said liquid ring pump has at least two single staged sections.

* * * * *